US007634101B2

(12) United States Patent
Kemmerer

(10) Patent No.: US 7,634,101 B2
(45) Date of Patent: Dec. 15, 2009

(54) THERMAL MANAGEMENT SYSTEM FOR LOUDSPEAKER HAVING INTERNAL HEAT SINK AND VENTED TOP PLATE

(75) Inventor: Jason Kemmerer, Torrance, CA (US)

(73) Assignee: Alpine Electronics, Inc, Tokyo (JP)

( * ) Notice: Subject to any disclaimer, the term of this patent is extended or adjusted under 35 U.S.C. 154(b) by 874 days.

(21) Appl. No.: 11/343,757

(22) Filed: Jan. 31, 2006

(65) Prior Publication Data

US 2007/0177756 A1 Aug. 2, 2007

(51) Int. Cl.

| | |
|---|---|
| ***H04R 1/00*** | (2006.01) |
| ***H04R 9/06*** | (2006.01) |
| ***H04R 11/02*** | (2006.01) |
| *H04R 25/00* | (2006.01) |

(52) U.S. Cl. ..... 381/397; 381/150; 381/396; 381/412

(58) Field of Classification Search ..... 381/397
See application file for complete search history.

(56) References Cited

U.S. PATENT DOCUMENTS 5,042,072 A * 8/1991 Button ..... 381/397
6,327,371 B1 * 12/2001 Proni ..... 381/397

FOREIGN PATENT DOCUMENTS

| | | |
|---|---|---|
| JP | 7-115698 | 5/1995 |
| JP | 2002-27591 | 1/2002 |

* cited by examiner

*Primary Examiner*—Brian Ensey
*Assistant Examiner*—Matthew Eason
(74) *Attorney, Agent, or Firm*—Muramatsu & Associates

(57) ABSTRACT

A thermal management system promotes cooling effects of a loudspeaker. The thermal management system includes an internal heat sink having a tubular shape and mounted between a pole piece and a magnet of the loudspeaker, the internal heat sink having pleat portions to form a plurality of air passages on an inner surface from top to bottom thereof; and a back plate connected to the pole piece and having ventilation holes that vertically penetrate through the back plate, the internal heat sink and the magnet being mounted on the back plate. A lower end of the air passage on the internal heat sink is positionally matched with an upper opening of the ventilation hole on the back plate, thereby allowing an air flow through the air passage and the ventilation hole.

13 Claims, 8 Drawing Sheets

THERMAL MANAGEMENT SYSTEM FOR LOUDSPEAKER HAVING INTERNAL HEAT SINK AND VENTED TOP PLATE

FIELD OF THE INVENTION

This invention relates to a thermal management system for a loudspeaker with an internal heat sink and a vented top plate for achieving an improved cooling performance to reduce heat in the loudspeaker, and more particularly, to an internal heat sink that has a pleat portion that increases a surface area of the internal heat sink and forms air passages, and a vented top plate whose openings are positionally matched to the air passages of the internal heat sink as well as to ventilation holes established on a back plate of the loudspeaker.

BACKGROUND OF THE INVENTION

Loudspeakers, or speakers, are well known in the art and are commonly used in a variety of applications, such as in home theater stereo systems, car audio systems, indoor and outdoor concert halls, and the like. A loudspeaker typically includes an acoustic transducer comprised of an electromechanical device which converts an electrical signal into acoustical energy in the form of sound waves and an enclosure for directing the sound waves produced upon application of the electrical signal.

An example of structure in the conventional loudspeaker is shown in FIG. 1. A loudspeaker 11 includes a speaker cone 13 forming a diaphragm 17, a coil bobbin 25, and a dust cap 15. The diaphragm 17, the dust cap 15 and the coil bobbin 25 are attached to one another. The voice coil 27 is attached around the coil bobbin 25. The voice coil 27 is connected to suitable electrical leads (not shown) to receive an electrical input signal through the electrical terminals (not shown).

The diaphragm 17 is provided with an upper half roll 21 at its peripheral made of flexible material. The diaphragm 17 connects to the speaker frame 19 at the upper half roll 21 by means of, for example, an adhesive. At about the middle of the speaker frame 19, the intersection of the diaphragm 17 and the coil bobbin 25 is connected to the speaker frame 19 through a spider (inner suspension) 23 made of flexible material. The upper half roll 21 and the spider 23 allow the flexible vertical movements of the diaphragm 17 as well as limit or damp the amplitudes (movable distance in an axial direction) of the diaphragm 17 when it is vibrated in response to the electrical input signal.

An air gap 41 and annular members including a pole piece 37, a permanent magnet 33, and an upper (top) plate 35, which establish a magnetic assembly. In this example, the pole piece 37 has a back plate 38 integrally formed at its bottom. The pole piece 37 has a central opening 40 formed by a pole portion 39 for dissipating heat generated by the voice coil 27. The permanent magnet 33 is disposed between the upper plate 35 and the back plate 38 of the pole piece 37. The upper plate 35 and the pole piece 37 are constructed from a material capable of carrying magnetic flux, such as steel. Therefore, a magnetic path or circuit is created through the pole piece 37, the upper plate 35, the permanent magnet 33 and the back plate 38 through which the magnetic flux runs.

The air gap 41 is created between the pole piece 37 and the upper plate 35 in which the voice coil 27 and the coil bobbin 25 are inserted in the manner shown in FIG. 1. Thus, when the electrical input signal is applied to the voice coil 27, the current flowing in the voice coil 27 and the magnetic flux (flux density) interact with one another. This interaction produces a force on the voice coil 27 which is proportional to the product of the current and the flux density. This force activates the reciprocal movement of the voice coil 27 on the coil bobbin 25, which vibrates the diaphragm 17, thereby producing the sound waves.

For a loudspeaker described above, heat within the loudspeaker and resultant distortion of sound can be problematic. The voice coil is constructed of a conductive material having electrical resistance. As a consequence, when an electrical signal is supplied to the voice coil, the electric current flowing through the coil generates heat because of the interaction with the resistance. Therefore, the temperature within the loudspeaker and its enclosure will increase. A substantial portion of the electrical input power is converted into the heat rather than into acoustic energy.

Such temperature rise in the voice coil creates various disadvantages. As an example of disadvantage, it has been found that significant temperature rise increases the resistance of the voice coil. This, in turn, results in a substantial portion of the input power of the loudspeaker to be converted to the heat, thereby lowering the efficiency and performance of the loudspeaker. In particular, it has been found that the increased resistance of the voice coil in the loudspeaker can lead to non-linear loudness compression effects at high sound levels.

When additional power is supplied to compensate for the increased resistance, additional heat is produced, again causes an increase in the resistance of the voice coil. At some point, any additional power input will be converted mostly into heat rather than acoustic output. Further, significant temperature rise can melt bonding materials in the voice coil or overheat the voice coil, resulting in permanent structural damage to the loudspeaker.

Moreover, in the audio sound reproduction involving such a loudspeaker, it is required that the loudspeaker is capable of producing a high output power with low distortion in the sound waves. Low distortion in the sound wave means accurate reproduction of the sound from the loudspeaker. It is known in the art that a loudspeaker is more nonlinear and generates more distortion in lower frequencies which require large displacement of the diaphragm.

Thus, there is a need of an improved thermal management system for a loudspeaker that can dissipate heat efficiently while minimizing distortion of sound at the same time.

SUMMARY OF THE INVENTION

It is, therefore, an object of the present invention to provide a loudspeaker having an improved thermal management system for effectively controlling an inner temperature of the loudspeaker while minimizing distortions of sound.

The thermal management system for a loudspeaker is comprised of an internal heat sink having a tubular shape and mounted between a pole piece and a magnet of the loudspeaker, the internal heat sink having pleat portions to form a plurality of air passages on an inner surface from top to bottom thereof, and a back plate connected to the pole piece and having ventilation holes that vertically penetrate through the back plate, the internal heat sink and the magnet being mounted on the back plate. A lower end of the air passage on the internal heat sink is positionally matched with an upper opening of the ventilation hole on the back plate, thereby allowing an air flow through the air passage and the ventilation hole. A gap is formed between an outer surface of the pole piece and the inner surface of the internal heat sink for a voice coil of the loudspeaker is able to move therein.

Preferably, the ventilation holes on the back plate is outwardly inclined toward the bottom of the back plate in cross section. Further, the ventilation holes on the back plate are positioned away from a bottom corner of the pole piece to minimize interference to magnetic performance of the loudspeaker.

The thermal management system further includes a top plate mounted on the magnet of the loudspeaker for establishing a gap between an outer surface of the pole piece and an inner surface of the top plate for a voice coil of the loudspeaker to move therein, wherein the top plate has a plurality of ventilation grooves on the inner surface thereof. The ventilation grooves run from a top surface to a bottom surface of the top plate and a lower end of the ventilation groove is positionally matched to an upper end of the air passage formed on the internal heat sink, thereby allowing an air flow through the ventilation groove on the top plate, the air passage on the internal heat sink, and the ventilation hole on the back plate.

The thermal management system further includes a frame structure on which the back plate and the pole piece are mounted, a space for air flow being created between the frame structure and the back plate. The frame structure has openings to expose the back plate to an outside atmosphere, thereby allowing the air flows between an inner area and an outer area of the loudspeaker through the ventilation holes formed on the back plate.

According to the present invention, the thermal management system is configured by the internal heat sink, the vented top plate, and the back plate. The internal heat sink has a plurality of air passages to facilitate the air flows therethrough. The back plate of the loudspeaker has ventilation holes that are positionally matched with the openings of the air passages of the internal heat sink for efficient air circulation. The vented top plate has a plurality of ventilation grooves or cutouts which are positionally matched with the air passages on the internal heat sink. Thus, the thermal management system promotes the cooling effects of the loudspeaker by efficiently circulating the air between the inner area and the outer area of the loudspeaker.

BRIEF DESCRIPTION OF THE DRAWINGS

FIG. 2A is a top view of the internal heat sink, FIG. 2B is a perspective view showing an overall shape of the internal heat sink, FIG. 2C is a top view similar to FIG. 2A except that a back plate is additionally shown to depict the positional relationship between the back plate and the internal heat sink, and FIG. 2D is an enlarged top view of the internal heat sink showing structures of pleat portions and air passages.

DETAILED DESCRIPTION OF THE INVENTION

Referring to the accompanying drawings, the present invention is fully described which is a thermal management system for a loudspeaker. The thermal management system is basically configured by an internal heat sink, a vented top plate, and a back plate. The internal heat sink plays a major role for cooling the loudspeaker in combination with the back plate. The vented top plate further promotes the cooling effect of the loudspeaker in combination with the internal heat sink.

The internal heat sink has a tubular shape and is provided at an outer side of a pole piece. The internal heat sink has a plurality of pleats for increasing an surface area for promoting heat exchange and a plurality of passageways (air passages) to facilitate air flows for ventilating the air between the inside and outside of the loudspeaker. A back plate of the loudspeaker has penetrating ventilation holes that are positionally matched with the openings of the air passages of the internal heat sink for efficient air circulation. The vented top plate has a plurality of ventilation grooves or cutouts and is provided at the top of a magnetic circuit of the loudspeaker.

Figure 1:
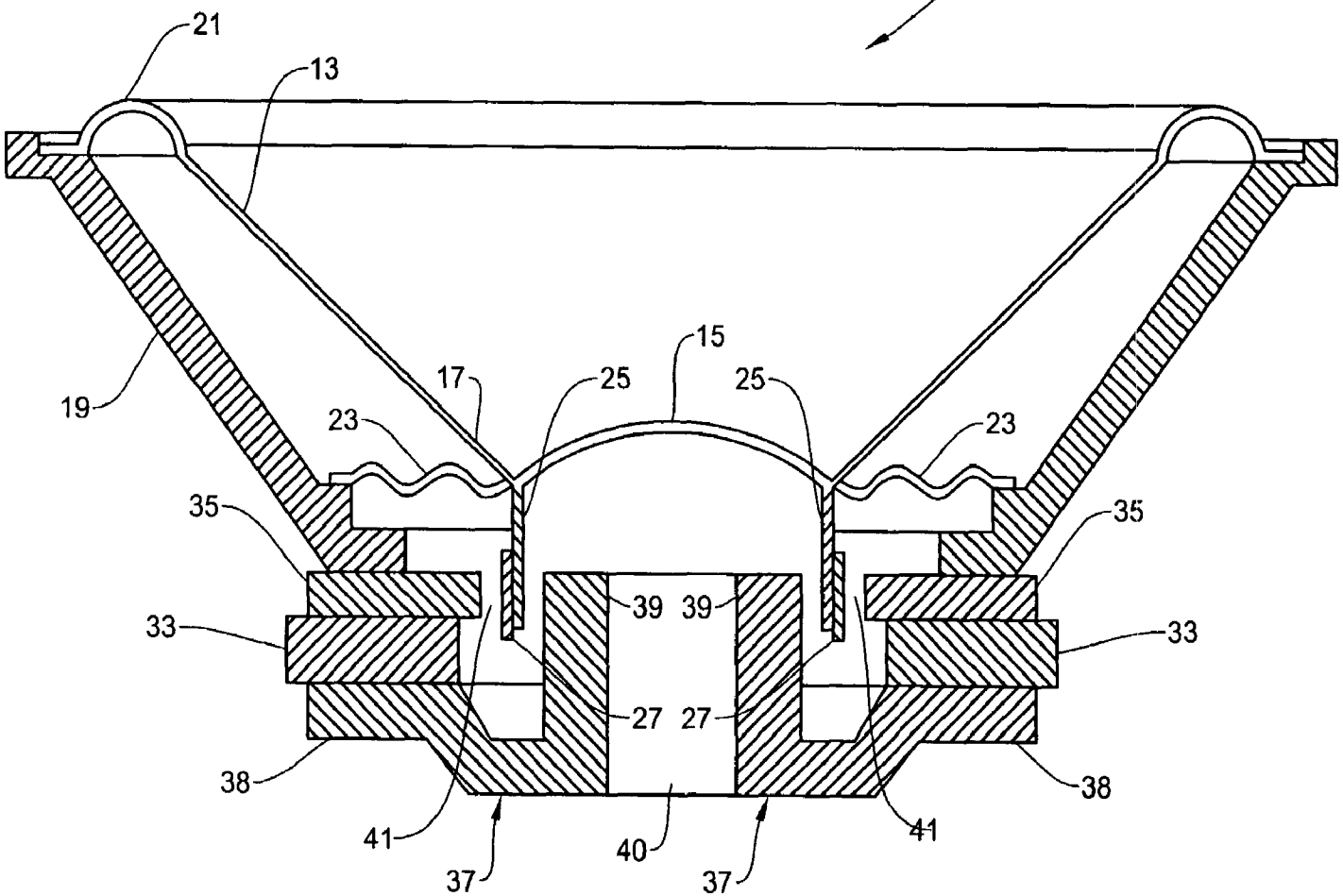
Fig. 1 (Prior Art)
FIG. 1 is a cross sectional view showing an example of inner structure of a loudspeaker in the conventional technology.
Figure 4:
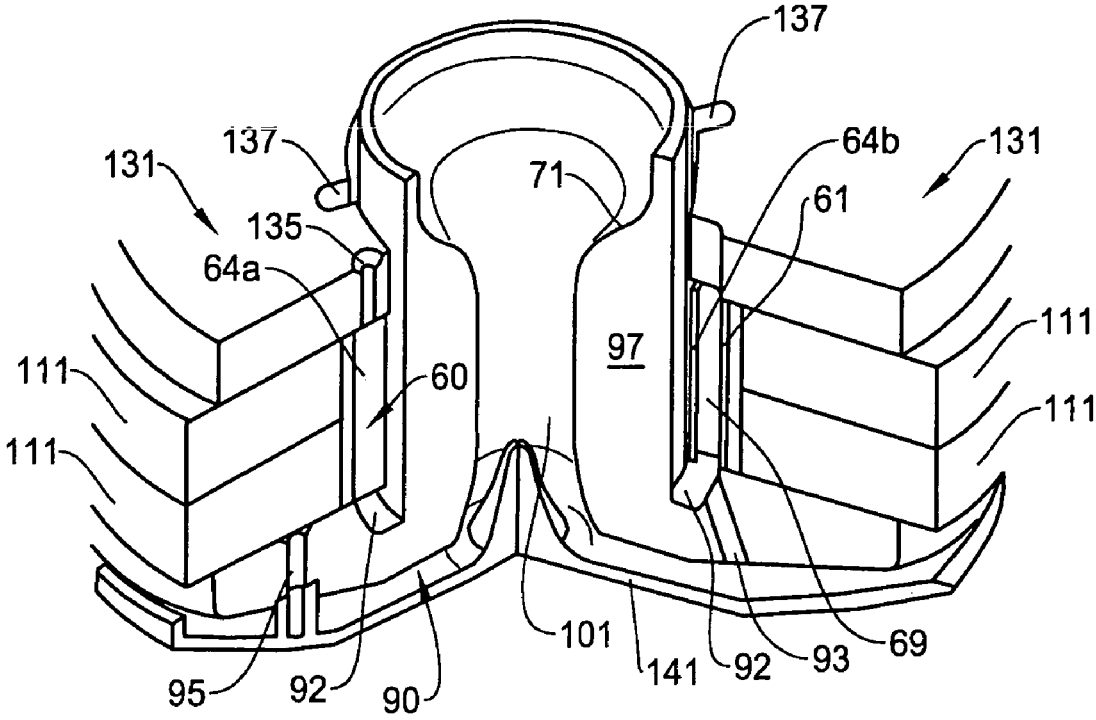
FIG. 4 is a perspective view of an embodiment of the thermal management system of the present invention where the internal heat sink and the vented top plate are assembled in the loudspeaker.

FIG. 4 is a cross sectional perspective view showing an inside structure of a loudspeaker implementing the thermal management system of the present invention. The perspective view of FIG. 4 shows a cross sectional structure of the loudspeaker taken along the line III of FIG. 2C. It should be noted that the left side of the line III in FIG. 2C runs across a back plate 90 in such a way to intersect with a screw hole 95, a rim portion 61 and an enclosing portion 64*a* while the right side of the line III runs across a rim portion 61 in such a way to intersect with a ventilation hole 93 on the back plate 90. Although not shown, in an actual embodiment, a voice coil and a coil bobbin such as shown in FIG. 1 are inserted in a gap formed between a pole piece and a top plate. The electric current flowing through the coil generates heat, which causes various problems as described above.

The thermal management system is basically configured by an internal heat sink 60, a vented top plate 131, and a back plate 90. The internal heat sink 60 has a tubular shape and is provided at the outer side of a pole piece 97 formed at the center of the loudspeaker. The internal heat sink 60 is comprised of a plurality of pleats which establish a plurality of air passages as well as increase a surface area for promoting heat exchange. Each pleat is formed of a rim portion 61, and enclosing portions 64*a* and 64*b* as will be described in detail later with reference to FIGS. 2A-2D.

The vented top plate 131 is made of magnetic material and mounted on magnets 111 of the loudspeaker in a manner to cover the magnets 111 and the internal heat sink 60. The vented top plate 131 has a plurality of ventilation grooves (cutouts) 137 which face an outer surface of the pole piece 97 with a small gap therebetween. The vented top plate 131 is mounted in a manner that a ventilation groove 137 is positionally aligned with the air passage formed on the internal heat sink 60.

Typically, the back plate 90 is integrally configured with the pole piece 97 and outwardly extended at the bottom for mounting the magnets 111 thereon. Alternatively, the back plate 90 is separately produced and mechanically connected to the pole piece 90 when assembled in the loudspeaker. The back plate 90 is mounted on a frame structure 141 of the loudspeaker and exposed to the outside atmosphere because the frame structure 141 has openings. In the present invention, the back plate 90 has a plurality of ventilation holes 93 each penetrating from the top surface to the bottom surface of the back plate. On the top surface of the back plate 90, the ventilation holes are positionally matched with the air passages of the internal heat sink 60.

Figure 2A:
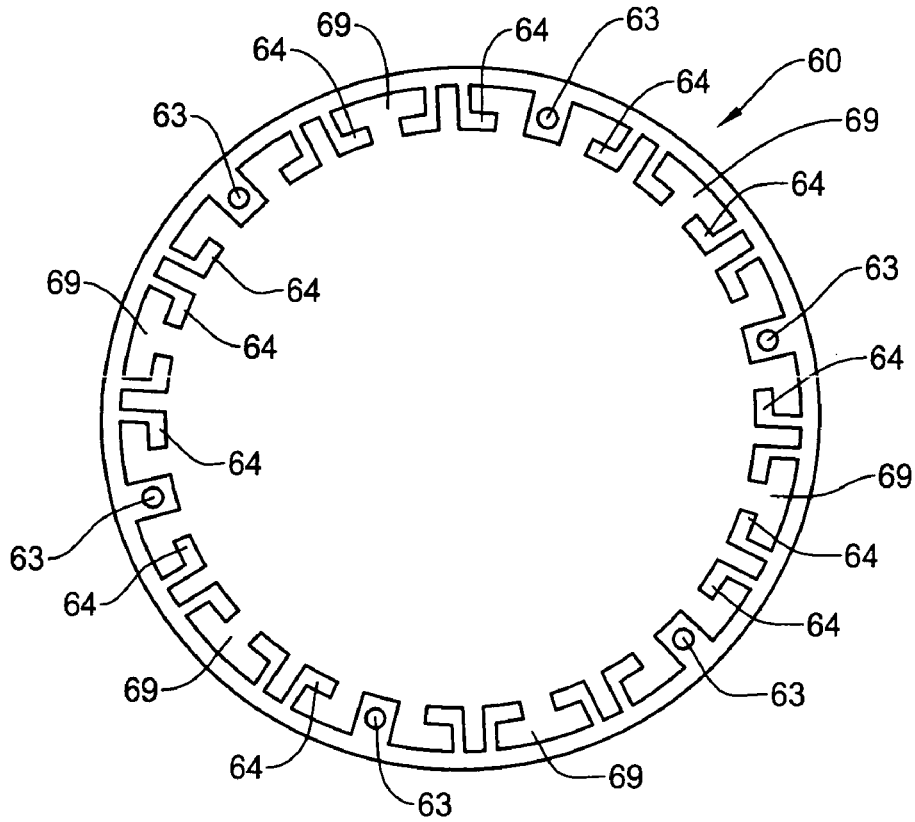
FIGS. 2A-2D show an example of structure of an internal heat sink in accordance with the present invention where
Figure 2B:
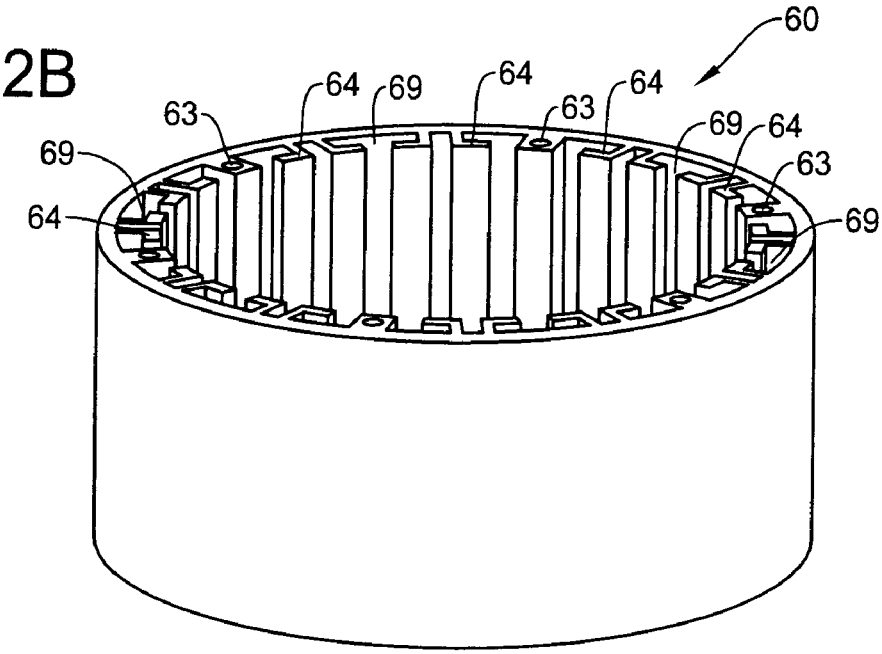

Referring now to FIGS. 2A-2D, the internal heat sink 60 in the preferred embodiment of present invention is described in more detail. FIG. 2A is a top view of the internal heat sink 60 and FIG. 2B is a perspective view of the internal heat sink 60. The internal heat sink 60 has a cylinder or tubular shape with an inner diameter larger than the outer diameter of the pole piece 97. Thus, the internal heat sink 60 mounted on the loudspeaker at the outside of the pole piece 97.

The internal heat sink 60 has a plurality of pleat portions 64 on an inner surface thereof, a multiplicity of screw holes 63, and a multiplicity of air passages 69 that are formed by the pleat portions 64. The screw holes 63 are used for fastening the internal heat sink 60 to the vented top plate 131. Each pleat portion 64 has enclosing portions 64*a* and 64*b* as will be described later in more detail with reference to FIG. 2D. The pleat portions 64 play a role of increasing the surface area for promoting heat exchange as well as forming the air passages 69. The air passages 69 configured by the pleat portions 64 run from the top to the bottom on the inner wall of the internal heat sink 60.

As shown, in the perspective view of FIG. 2B, the internal heat sink 60 has an adequate height to accommodate the size and configuration of a loudspeaker to which the heat sink 60 is to be implemented. Typically, the height of the internal heat sink 60 is equal to the vertical thickness of the magnets 111 so that it contacts with the vented top plate 131 at its top and contacts with the back plate 90 at its bottom.

Figure 2C:
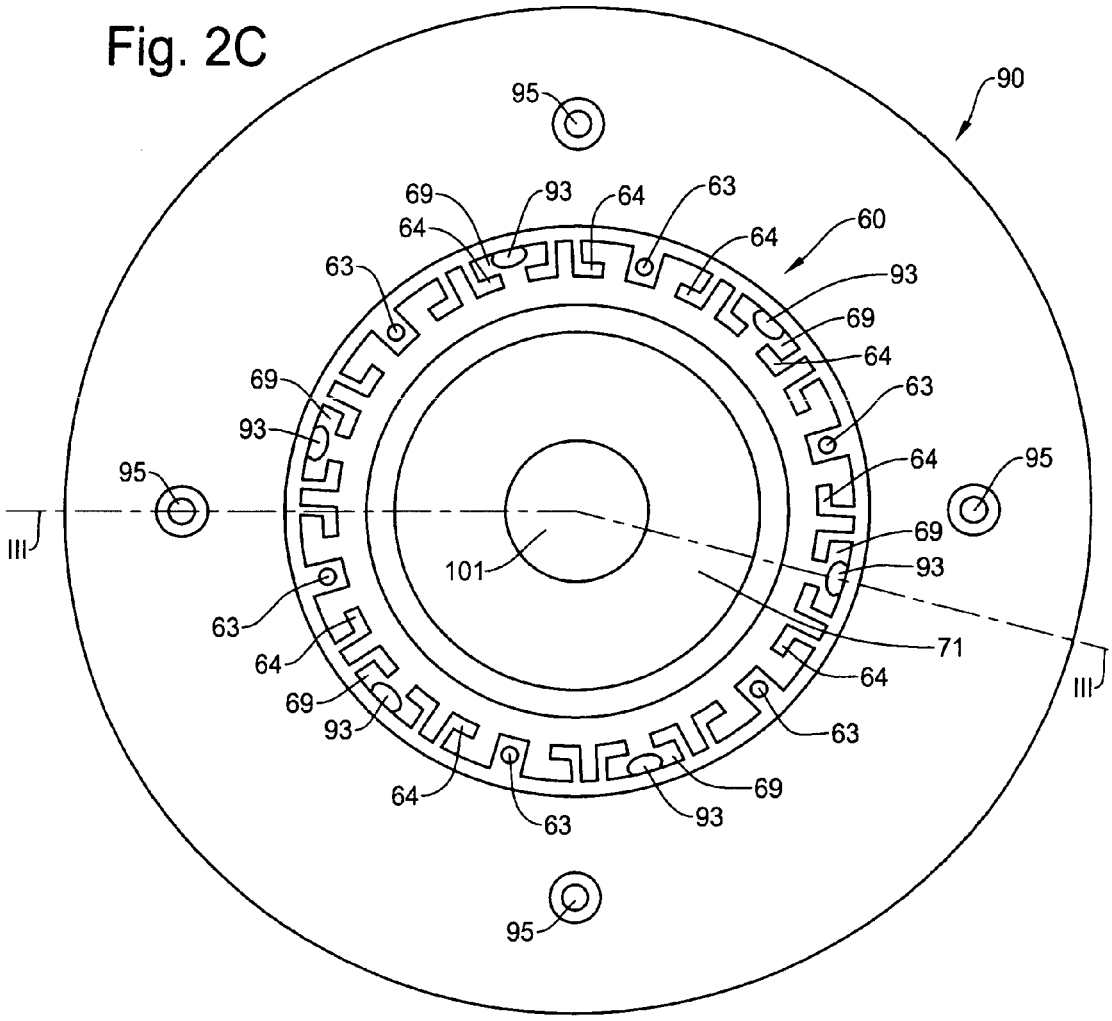

FIG. 2C is a top view of the internal heat sink 60 and the back plate 90. In FIG. 2C, the vented top plate 131, the magnets 111, and the frame structure 141 are not shown for simplicity of explanation. The internal heat sink 60 has pleat portions 64 at the inside perimeter, i.e., inner surface facing the outer surface of the pole piece 97. As noted above, the pleat portions 64 increase the surface area of the internal heat sink 60 to promote the heat exchange and dissipation as well as establish the multiplicity of air passages 69.

Figure 3:
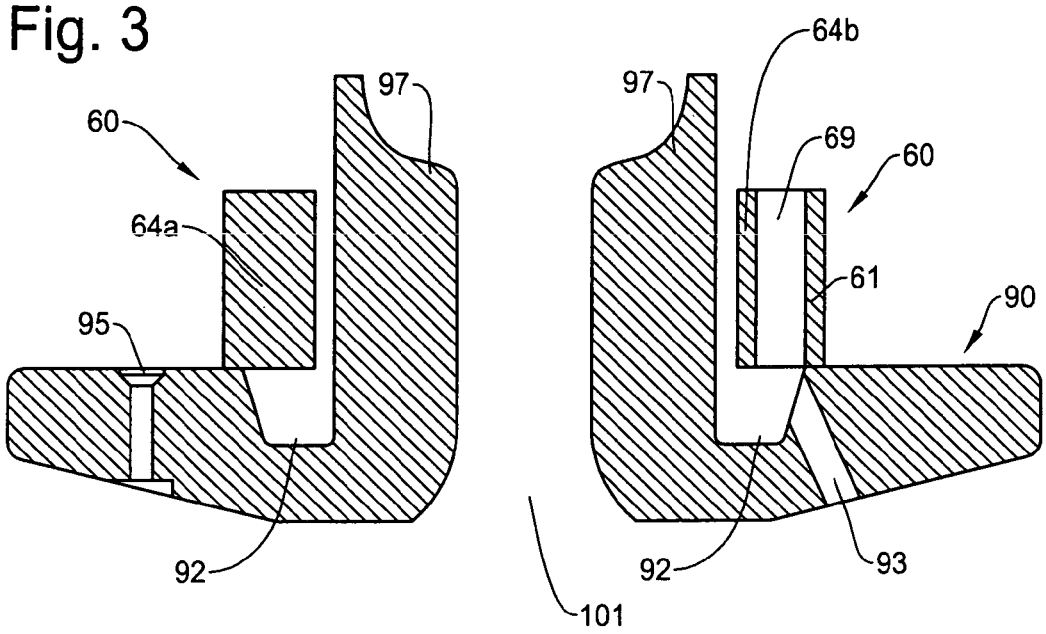
FIG. 3 is a cross sectional view taken along the line III of FIG. 2C showing an example of structure of the thermal management system for a loudspeaker in accordance with the present invention.

The structure of the back plate 90 involved in the thermal management system is illustrated in the cross sectional view of FIG. 3 and cross sectional perspective view of FIG. 4, taken along the line III of FIG. 2C. For attaining a high magnetic performance, the back plate 90 has a unique cross sectional structure having a dented portion 92 at an upper surface thereof (outer bottom surface of the pole piece 97). A multiplicity of ventilation holes 93 are formed on the back plate 90 in a manner to penetrate through the back plate 90 from the upper surface to the lower surface.

In this example, the top opening of the ventilation hole 93 is located radially outer area of the dented portion 92 and the bottom opening of the ventilation hole 93 is located further radially outer area of the bottom surface of the back plate 90. In other words, the ventilation holes 93 are diagonally provided as shown in FIGS. 3 and 4 so as not to adversely affect the magnetic performance of the pole piece 97 and back plate 90. Further, since the bottom corner of the pole piece 97 (portion integrally connected to the back plate 90) has a high magnetic flax density, the ventilation holes 93 are formed away from the bottom corner of the pole piece 97 so as not to adversely affect the magnetic performance.

Figure 2D:
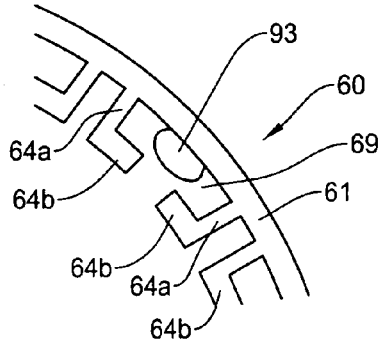

The top opening of the ventilation hole 93 is designed to positionally match the air passage 69 formed by the internal heat sink 60 as seen from the top views of FIGS. 2C and 2D, although the number of the ventilation holes is smaller than that of the air passages 69. The cross sectional views of FIGS. 3 and 4 show the ventilation hole 93 where the top opening thereof is located right under the air passage 69 of the internal heat sink 60. Thus, the outside cool air can come in the inner area of the loudspeaker through the ventilation hole 93 and the air passage 69 while the inner heated air can go out to the outside through the air passage 69 and the ventilation hole 93. As shown in FIG. 2C, the back plate 90 also has screw holes 95 that are used for fastening the back plate 90 to the frame structure 141.

In FIGS. 3 and 4, an air passage 101 is formed at the center of the pole piece 97 to allow the air to pass through for ventilation between the inner area and outer bottom of the loudspeaker. The opening of the air passage 101 at the top of the pole piece is inwardly curved as indicated by a curvature 71 in FIG. 4. This curvature 71 is designed for optimum flux density in the magnetic circuit and smooth air flows for cooling. In addition to the air passage 101, the internal heat sink 60 in accordance with the present invention further promotes the cooling performance of the loudspeaker.

The detailed structure of the pleat portions 64 and the air passages 69 formed on the internal heat sink 60 is described with reference to an enlarged top view of FIG. 2D. The air passage 69 is comprised of enclosing portions 64*a* and 64*b* of the pleat portion 64, and the rim portion 61 of the internal heat sink 60. As seen from FIG. 2D, the ventilation hole 93 formed on the back plate 90 is positionally matched with the bottom of the air passage 69. Thus, an air flow path is created from the inner area to the outer area of the loudspeaker through the air passage 69 on the internal heat sink 60 and the ventilation hole 93 on the back plate 90, thereby improving the overall convection effect of the loudspeaker.

As shown in FIGS. 4 and 6, a space is provided between the bottom of the back plate 90 and the frame structure 141. As is well known in the art, a frame structure and a back plate of a loudspeaker are exposed to outer atmosphere. Thus, a cool air can come in the inner area of the loudspeaker through the ventilation hole 93 on the back plate 90 and the air passages 69 on the internal heat sink 60. Further, the heated air in the inner area of the loudspeaker can go outside of the speaker through the air passages 69 on the internal heat sink 60 and the ventilation hole 93 on the back plate 90.

Figure 5:
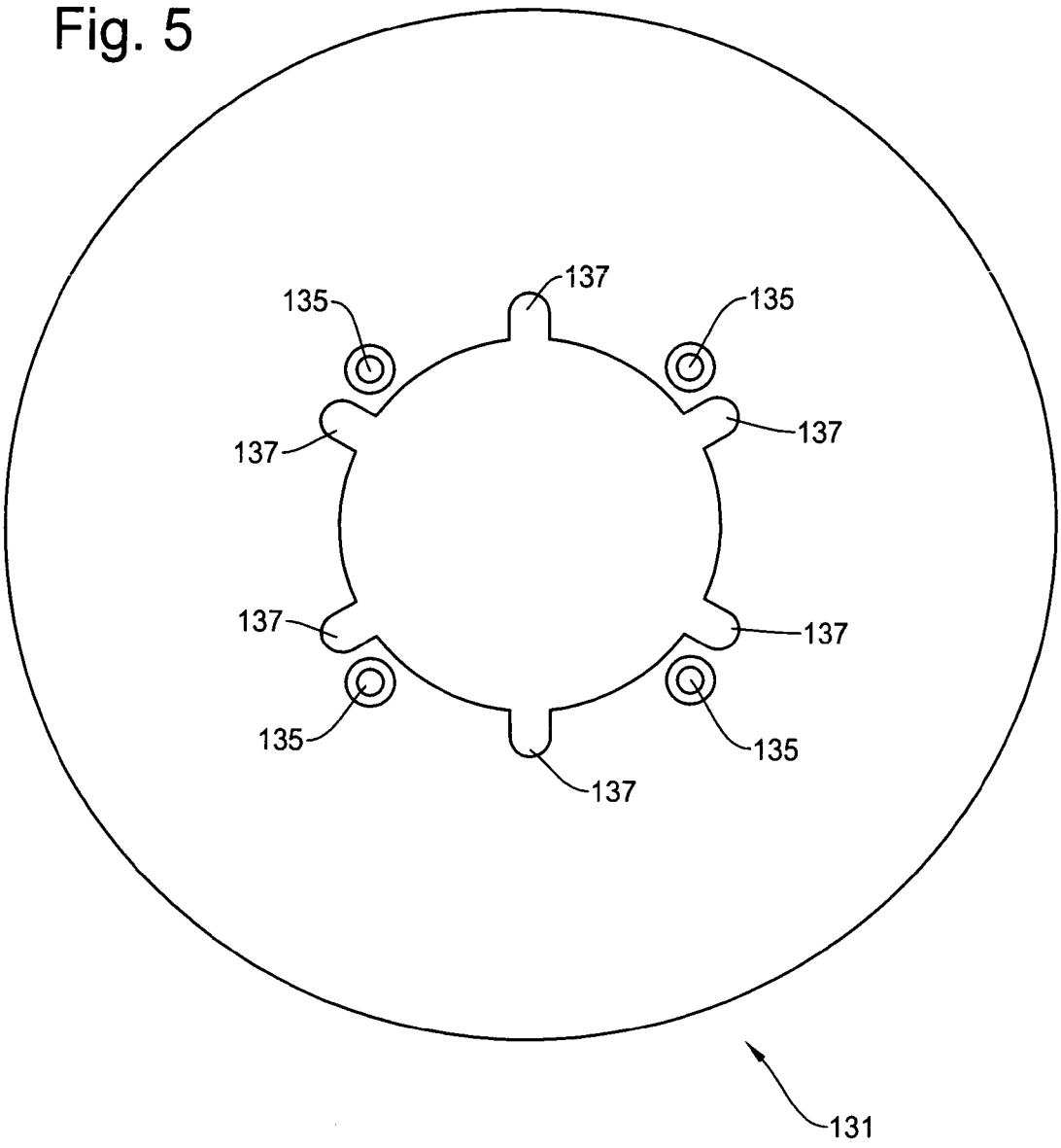
FIG. 5 is a top view of the vented top plate for establishing the thermal management system of the loudspeaker in combination with the internal heat sink in accordance with the present invention.

FIG. 5 is a top view of the vented top plate 131 in the embodiment of the present invention. The vented top plate 131 has a center opening to form adequate space (gap) between the pole piece 97 for the voice coil to move up and down when the electrical signal is applied to the voice coil. As shown in FIG. 4, the vented top plate 131 is mounted on the magnets 11 and the internal heat sink 60. Screw holes 135 are provided for fastening the vented top plate 131 to the internal heat sink 60. The ventilation grooves 137 are formed on an inner wall of the vented top plate 131. Although the number of ventilation grooves 137 is smaller than that of the air passages 69 on the internal heat sink 60, the ventilation holes 137 are designed to positionally match to the air passages 69 and the ventilation holes 93 on the back plate 90.

Figure 6A:
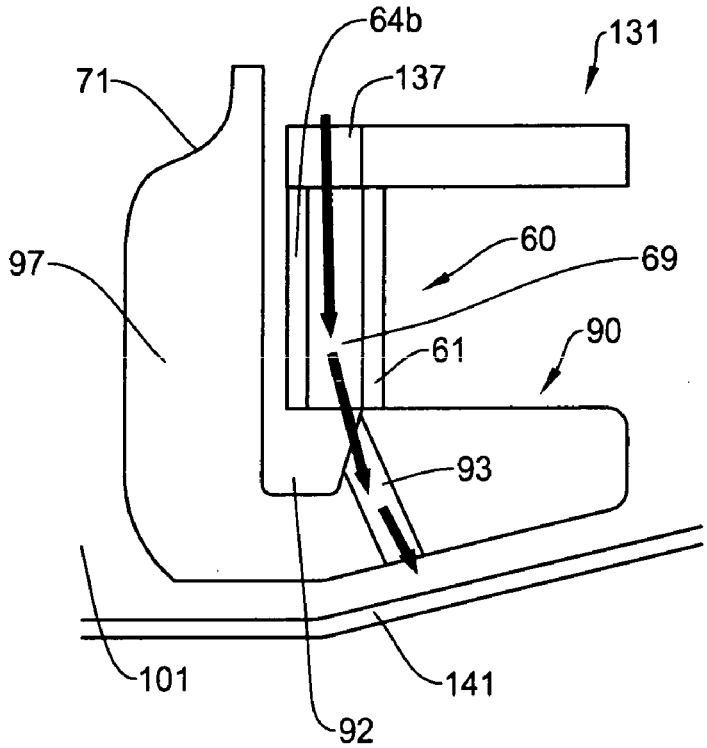
FIGS. 6A and 6B are cross sectional views schematically showing an example of overall air flows based on the thermal management system of the present invention.
Figure 6B:
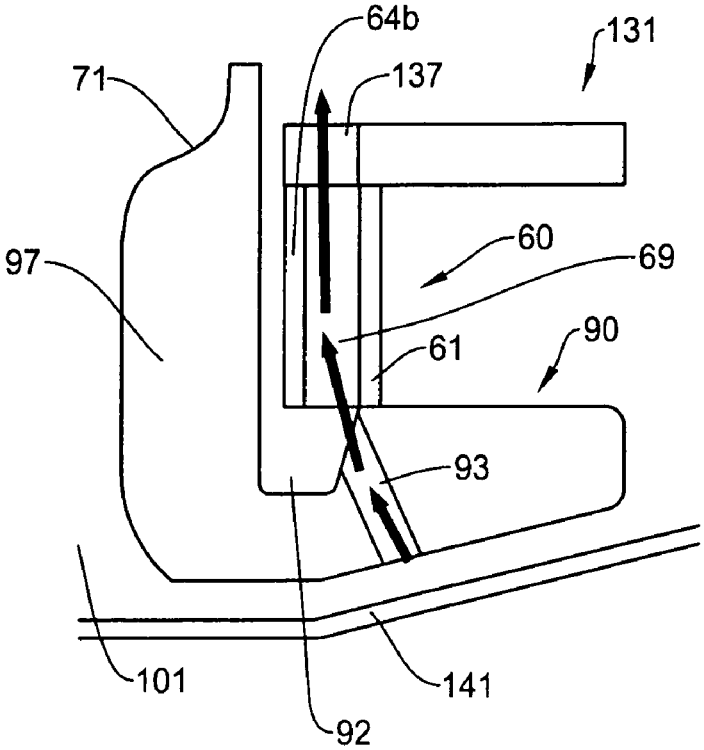

FIGS. 6A and 6B are cross sectional views which schematically show overall air flows in the thermal management system of the present invention. The arrows in indicate the flow of air by the thermal management system. In FIG. 6A, the heated air produced by the voice coil is flowing out through the ventilation grooves 137 on the vented top plate 131, the air passages 69 on the internal heat sink 60, and the ventilation holes 93 on the back plate 90. In FIG. 6B, the outside cool air is flowing in the inner area of the loudspeaker through the ventilation holes 93 on the back plate 90, the air passages 69 on the internal heat sink 60, and the ventilation grooves 137 on the vented top plate 131. The space between the back plate 90 and the frame structure 141 is established by a support structure 143 shown in FIG. 4. Because of the air flow is facilitated by the thermal management system of the present invention, the heat generated by the voice coil of the loudspeaker can be efficiently dissipated.

Figure 7A:
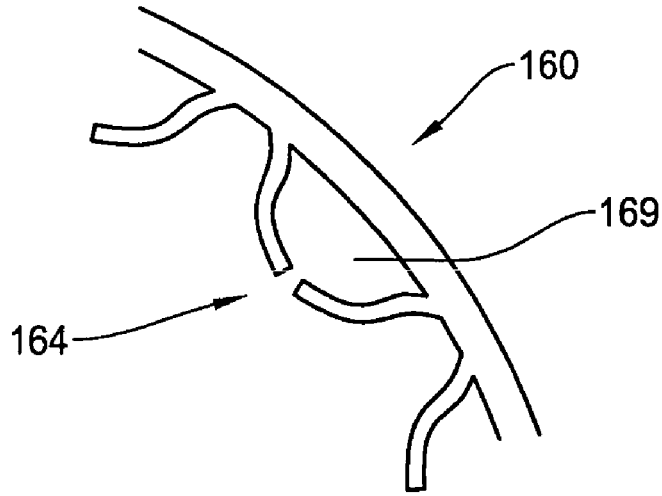
FIGS. 7A and 7B are enlarged top views showing examples of structure of alternative designs of the pleat portions of the internal heat sink in accordance with the present invention.
Figure 7B:
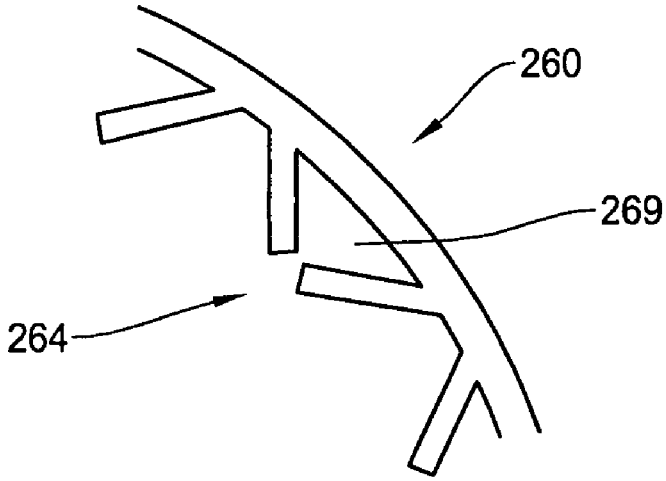

In the preferred embodiment described above, the pleat portion 64 of the internal heat sink 60 forms a substantially rectangular air passage in top view. However, the pleat portion 64 can take other configurations and still achieve the advantages of the present invention described above. FIGS. 7A and 7B show examples of alternative design of pleat portions of the internal heat sink in the present invention. In the example of FIG. 7A, pleat portions 164 are curved, and thus, an air passage 169 is substantially semicircular in top view. In the example of FIG. 7B, pleat portions 264 are straight and diagonal, and thus, an air passage 169 is substantially triangular in top view. Both pleat portion examples increase the surface area to promote efficient dissipation of heat, and form air passages for air to pass through.

As has been described above, according to the present invention, the thermal management system is configured by the internal heat sink, the vented top plate, and the back plate. The internal heat sink has a plurality of air passages to facilitate the air flows therethrough. The back plate of the loudspeaker has ventilation holes that are positionally matched with the openings of the air passages of the internal heat sink for efficient air circulation. The vented top plate has a plurality of ventilation grooves or cutouts which are positionally matched with the air passages on the internal heat sink. Thus, the thermal management system promotes the cooling effects of the loudspeaker by efficiently circulating the air between the inner area and the outer area of the loudspeaker.

Although the invention is described herein with reference to the preferred embodiment, one skilled in the art will readily appreciate that various modifications and variations may be made without departing from the spirit and scope of the present invention. Such modifications and variations are considered to be within the purview and scope of the appended claims and their equivalents.

What is claimed is:

1. A thermal management system for a loudspeaker, comprising:

an internal heat sink having a tubular shape and mounted between a pole piece and a magnet of the loudspeaker, the internal heat sink having pleat portions to form a plurality of air passages on a surface from top to bottom thereof; and a back plate connected to the pole piece and having ventilation holes that vertically penetrate through the back plate, the internal heat sink and the magnet being mounted on the back plate;

wherein a lower end of the air passage on the internal heat sink is positionally matched with an upper opening of the ventilation hole on the back plate, thereby allowing an air flow through the air passage and the ventilation hole.

2. A thermal management system for a loudspeaker as defined in claim 1, wherein the ventilation holes on the back plate is outwardly inclined toward the bottom of the back plate in cross section.

3. A thermal management system for a loudspeaker as defined in claim 1, wherein the ventilation holes on the back plate are positioned away from a bottom corner of the pole piece to minimize interference to magnetic performance of the loudspeaker.

4. A thermal management system for a loudspeaker as defined in claim 1, wherein said pleat portions form the air passages as well as to increase a surface area of the internal heat sink for promoting heat exchange.

5. A thermal management system for a loudspeaker as defined in claim 1, wherein a gap is formed between an outer surface of the pole piece and an inner surface of the internal heat sink for a voice coil of the loudspeaker is able to move therein.

6. A thermal management system for a loudspeaker as defined in claim 1, further comprising a top plate mounted on the magnet of the loudspeaker for establishing a gap between an outer surface of the pole piece and an inner surface of the top plate for a voice coil of the loudspeaker to move therein, wherein the top plate has a plurality of ventilation grooves on the inner surface thereof.

7. A thermal management system for a loudspeaker as defined in claim 6, wherein the ventilation grooves run from a top surface to a bottom surface of the top plate and a lower end of the ventilation groove is positionally matched to an upper end of the air passage formed on the internal heat sink, thereby allowing an air flow through the ventilation groove on the top plate, the air passage on the internal heat sink, and the ventilation hole on the back plate.

8. A thermal management system for a loudspeaker as defined in claim 1, further comprising a frame structure on which the back plate and the pole piece are mounted, a space for air flow being created between the frame structure and the back plate.

9. A thermal management system for a loudspeaker as defined in claim 8, wherein the frame structure has openings to expose the back plate to an outside atmosphere, thereby allowing air flows between an inner area and an outer area of the loudspeaker through the ventilation holes formed on the back plate.

10. A thermal management system for a loudspeaker as defined in claim 1, wherein the back plate is integral with the pole piece of the loudspeaker.

11. A thermal management system for a loudspeaker as defined in claim 1, wherein an opening of the air passage on the internal heat sink is generally rectangular in cross section.

12. A thermal management system for a loudspeaker as defined in claim 1, wherein an opening of the air passage on the internal heat sink is generally semi-circular in cross section.

13. A thermal management system for a loudspeaker as defined in claim 1, wherein an opening of the air passage on the internal heat sink is generally triangular in cross section.

* * * * *